US007563020B2

(12) United States Patent
Pittet

(10) Patent No.: US 7,563,020 B2
(45) Date of Patent: Jul. 21, 2009

(54) CONTROL STEM DEVICE FOR A WATCH

(75) Inventor: Jan Pittet, Le Lieu (CH)

(73) Assignee: Montres Breguet SA, L'Abbaye (CH)

( * ) Notice: Subject to any disclaimer, the term of this patent is extended or adjusted under 35 U.S.C. 154(b) by 109 days.

(21) Appl. No.: 11/460,020

(22) Filed: Jul. 26, 2006

(65) Prior Publication Data

US 2007/0025191 A1 Feb. 1, 2007

(30) Foreign Application Priority Data

Jul. 26, 2005 (EP) ..... 05016139

(51) Int. Cl.
*G04B 27/02* (2006.01)

(52) U.S. Cl. ..... 368/190; 368/216; 368/308; 368/319

(58) Field of Classification Search ..... 368/319, 368/216, 190, 308
See application file for complete search history.

(56) References Cited

U.S. PATENT DOCUMENTS

| | | | | |
|---|---|---|---|---|
| 1,951,010 | A * | 3/1934 | Deck | 368/190 |
| 3,879,933 | A * | 4/1975 | Ikehata | 368/191 |
| 4,555,185 | A * | 11/1985 | Vuilleumier | 368/190 |
| 6,939,034 | B2 * | 9/2005 | Dubois | 368/190 |
| 2005/0169113 | A1 * | 8/2005 | Tokoro et al. | 368/319 |

FOREIGN PATENT DOCUMENTS

| | | |
|---|---|---|
| CH | 691 632 | 8/2001 |
| DE | 593 654 | 2/1934 |
| EP | 1 134 628 A1 | 9/2001 |

OTHER PUBLICATIONS

European Search Report issued in the corresponding application No. EP 05 01 6139 completed May 23, 2006.

* cited by examiner

*Primary Examiner*—Felix O. Figueroa
*Assistant Examiner*—Sean Kayes
(74) *Attorney, Agent, or Firm*—Griffin & Szipl, P.C.

(57) ABSTRACT

The control stem device for a watch includes a first stem (1) rotating about its longitudinal axis and provided with means (32) for securing it to a manual control crown on the exterior of the watch, and a second stem (2), substantially parallel and shifted in relation to said first stem and secured to an axially mobile sliding pinion (8) for selectively driving in rotation a mechanism for a first function (20) and a mechanism for a second function (242), the first and second stems being connected in rotation by a transmission device (5). The first stem is mounted to be axially mobile at least between an operating position associated with said first function and an operating position associated with said second function, so as to activate, by sliding between said positions, a pull-out mechanism (6) which cooperates with said sliding pinion (8) to make said pinion pass from one axial position to another, said sliding pinion (8) being meshed with the mechanism for the first function in one of its positions and with the mechanism for the second function in the other position. The first stem (1) slides in the first pinion (35) of the gear and can be removed. This device allows the control crown to be placed half way up the watchcase, in particular in the case of a watch with complications having a very thick movement.

10 Claims, 2 Drawing Sheets

CONTROL STEM DEVICE FOR A WATCH

BACKGROUND OF THE INVENTION

This application claims priority from European Patent Application No. 05016139.7 filed 26 Jul. 2005, the entire disclosure of which is incorporated herein by reference.

The present invention concerns a control stem device such as a winding and time-setting stem for a watch, including a first stem rotating about its longitudinal axis and provided with means for securing it to a manual control crown on the exterior of the watch, and a second rotating stem, substantially parallel and shifted relative to the first and provided with means for selectively driving a winding mechanism and a time-setting mechanism in rotation, the first and second stems being connected in rotation by a transmission device.

The use of two stems shifted in height and kinematically connected, instead of the usual winding stem in a single piece or in two aligned pieces, can be advantageous in a mechanical watch with complications, when the complication elements have to occupy space between the dial and the basic movement and thus lead to the movement being placed lower than the median plane of the watch. The external crown of a conventional winding stem would then be considerably closer to the back cover of the case than to the bezel, which would be both inconvenient and unattractive. The two-stem device allows the crown to be kept in its conventional and convenient place, half way up the case.

In known devices of this type, for example those disclosed in CH Patent No. 691 632 and in EP Patent Application No. 1 1 34 628, the two stems are connected in rotation by a transmission device and are further secured in translation, such that the second stem follows the first when the user pulls out the control crown. Consequently, the second stem, namely the one that extends inside the movement, fulfils all the functions of a conventional stem and has to be fitted with the same members (pull-out piece, sliding pinion, winding pinion, etc.) as a conventional stem. Because of the place occupied by the gear connecting the two stems, the designer is forced to shift these members slightly towards the interior of the movement. Moreover, the connection for securing the two stems in translation requires a mobile frame containing the gear and increasing the space requirement of the device. The axial play that inevitably exists in this frame causes inaccuracies in the axial positions of the first stem, given that the axial position is mainly indexed on the second stem.

SUMMARY OF THE INVENTION

It is an object of the invention to create an improved device relative to the state of the art, in that it exhibits greater simplicity and compactness.

Thus, there is provided a device of the type indicated in the preamble, characterized in that said first stem is mounted so as to move axially at least between an operating position associated with said first function and an operating position associated with said second function, so as to activate, by sliding between said positions, a pull-out mechanism that cooperates with a sliding pinion fixedly mounted in rotation on said second stem and mobile axially, in order to make it pass from one axial position to another, the sliding pinion being meshed with the mechanism of the first function in one of its positions and with the mechanism of the second function in the other position.

Thus, the second stem is made to switch between the two functions via the axial movement of the first stem by means of a conventional pull-out mechanism, which avoids the aforementioned drawbacks of a frame that is mobile in translation. The pull-out device has the advantage of being tried and tested and of low height, and it defines itself the positions associated with the two functions owing to the springs that it contains. Moreover, the device easily allows a watchmaker to uncouple the pull-out piece and the first stem, which enables the latter to be mounted and dismantled through the corresponding aperture in the watchcase as in the case of a conventional broken stem.

According to a preferred embodiment of the invention, the second stem includes a section of non-circular transverse cross-section, for example square cross-section, on which the sliding pinion is slidably engaged, said pinion having a peripheral groove in which one end of a lever of the pull-out mechanism is engaged. This results in a very compact construction with simplified bearings.

BRIEF DESCRIPTION OF THE DRAWINGS

Other features and advantages of the present invention will appear from the following description, which shows a preferred embodiment by way of non-limiting example with reference to the annexed drawings, in which.

DETAILED DESCRIPTION OF ONE EMBODIMENT

Figure 1:
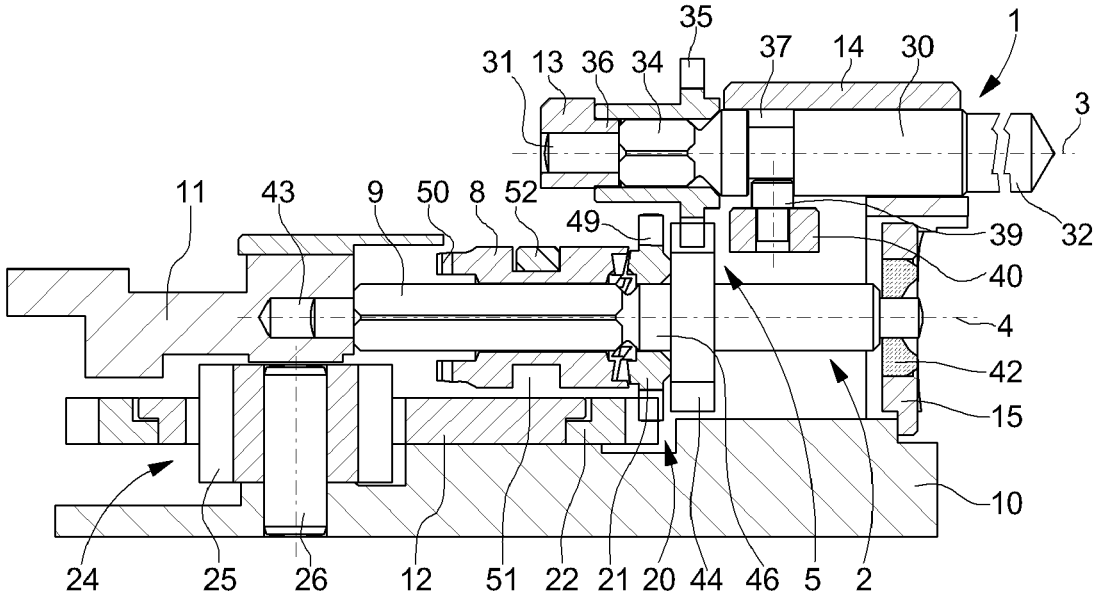
FIG. 1 is a longitudinal cross-section of the device according to the invention, in winding position.

The device shown in the drawings includes two winding and time-setting stems, namely a first stem 1 and a second stem 2, whose respective rotational axes 3 and 4, are parallel, but shifted in height in relation to each other, in a perpendicular or oblique direction in relation to the general plane of the watch movement. These stems are connected by two kinematic connections, namely a gear transmission device 5, which is permanently meshed and transmits the rotation from one stem to the other, and a pull-out mechanism 6 shown in FIG. 3, which transmits axial movements from first stem 1 to a sliding pinion 8 slidably mounted on a square section 9 of second stem 2, to which it is secured in rotation owing to its central square orifice. In the embodiment shown here, stem 2 does not slide, i.e. its axial position is fixed.

The whole of the device is carried, from a plate of the watch movement, by fixed elements or bridges 10, 11, 12, 13, 14 and 15. Mounted on these fixed elements there is also a winding mechanism 20, of which a winding pinion 21 and an intermediate wheel 22 can be seen in the drawings, and a time-setting mechanism 24, of which an intermediate motion work wheel 25 which rotates on a post 26.

Figure 2:
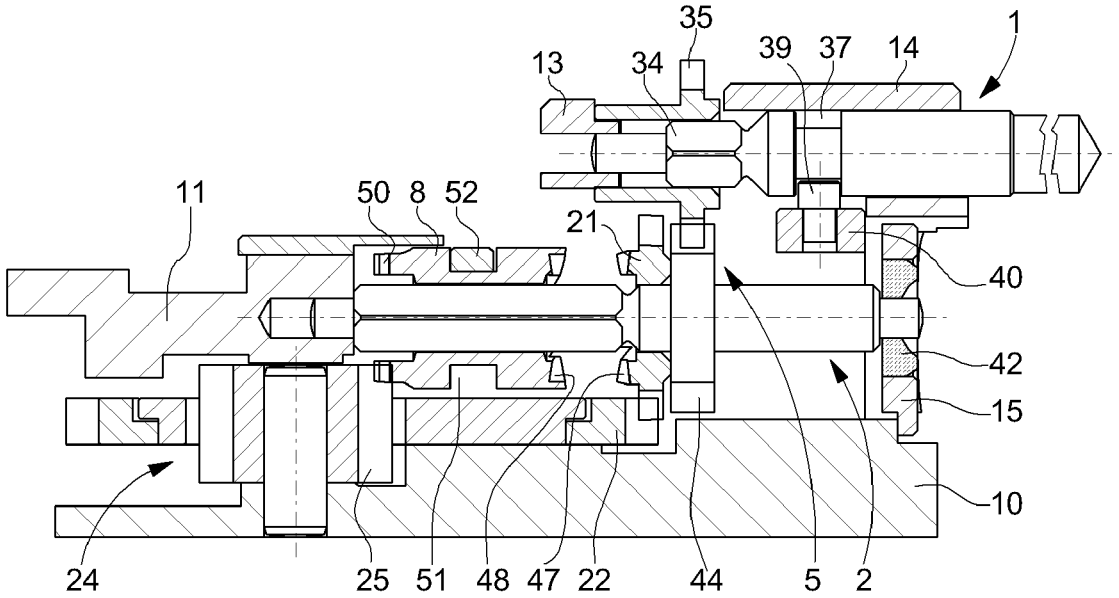
FIG. 2 shows the device of FIG. 1 in a time-setting position.

The first stem 1 includes a first cylindrical part 30 and a second cylindrical part 31, of smaller diameter than that of the first part, and these latter are slidably mounted in bores of fixed elements 14 and 13 acting as bearings, such that stem 1 can slide between the winding position shown in FIG. 1 and the time-setting position shown in FIG. 2. In other embodiments, stem 1 could have a third position, for example for setting the date. Like a conventional winding stem, stem 1 includes a threaded end 32 that passes through the watchcase and carries a manual control crown outside the case.

One portion 34 of stem 1 having a square section is engaged in an orifice of matching section of a first pinion 35, which is held axially between fixed elements 13 and 14. The central orifice of pinion 35 further comprises a section whose section is circular and which is fitted onto a cylindrical part 36 of element 13, this part acting as a bearing for supporting pinion 35 radially when stem 1 is removed, for example to fit the movement. An annular groove 37 is provided in cylindrical part 30 of stem 1, in which a post 39 of pull-out piece 40 is engaged. The pull-out piece can be lowered to release the post from the groove when a watchmaker wishes to remove stem 1.

Both ends of stem 2 are provided with cylindrical pivots. A jewel 42, mounted in element 15 and a bore 43 of element 11, form rotational bearings which support stem 2 and hold it axially. A pinion 44, secured to stem 2, is permanently meshed on pinion 35 and thus forms the last pinion of the transmission device. If necessary, this transmission device could include an intermediate pinion between pinions 35 and 44 so that the two stems 1 and 2 rotate in the same direction, in accordance with the principle that forms the subject of the aforecited EP Patent Application No. 1 134 628, but this extra pinion is not generally necessary with the device according to the present invention. Moreover, it will be noted that the device described here does not require any bearings on the watchcase.

Pinion 44 is flanked by winding pinion 21 which can abut axially thereon and which is freely mounted on a cylindrical shoulder 46 of stem 2. Pinion 21 is of conventional construction, comprising a Breguet type contrate toothing 47, able to cooperate with a matching contrate toothing 48 of sliding pinion 8, and a straight toothing 49, which meshes permanently with intermediate wheel 22. The other end of sliding pinion 8 is provided with a straight toothing which meshes on intermediate motion work wheel 25 in the time-setting position shown in FIG. 2. Sliding pinion 8 also has a peripheral groove 51 in which a lever 52 of pull-out mechanism 6 is engaged.

Figure 3:
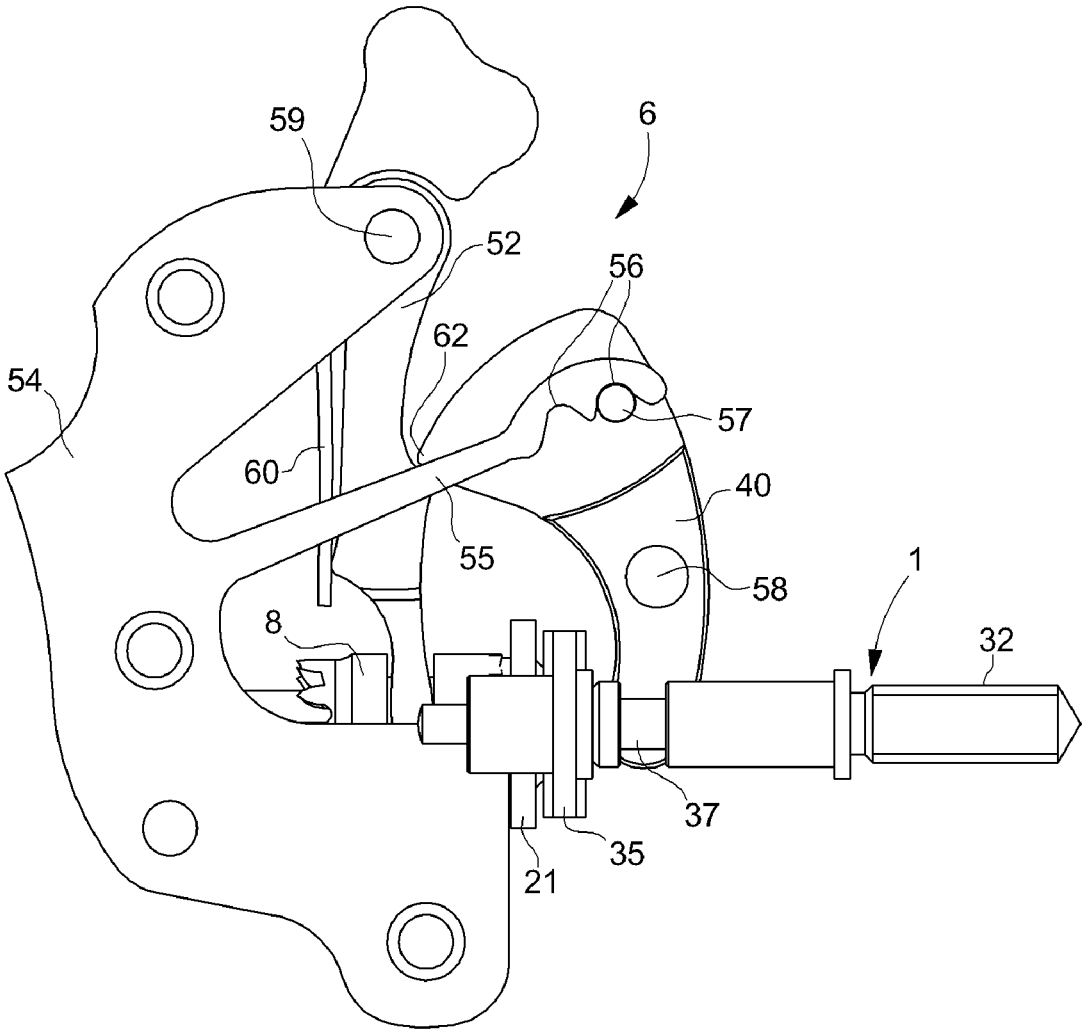
FIG. 3 is a plan view of a pull-out mechanism forming part of the device of FIG. 1.

FIG. 3 shows that pull-out mechanism 6 comprises, in addition to pull-out piece 40 and lever 52, a pull-out jumper 54 which is fixed and includes a jumper spring 55 provided with two catches 56 cooperating with a pin 57 of the pull-out piece. The pivoting axis of pull-out piece 40 is at 58 and that of lever 52 is at 59, the lever being pushed back towards the right in the drawing by a spring 60.

The device operates in the following manner. In the winding position illustrated in FIG. 1, the first stem 1 is in the pushed-in position, such that the crown that it carries is placed against the watchcase. Pull-out piece 40 is held by jumper spring 55 in the position shown in FIG. 3 and it thus holds first stem 1 by means of its post 39. Lever 52, pushed by spring 60, keeps sliding pinion 8 engaged on winding pinion 21. Thus, when the user rotates first stem 1, the latter drives in rotation first pinion 35, second pinion 44, second stem 2, sliding pinion 8, winding pinion 21 and winding mechanism 20.

When the user places first stem 1 in its pulled-out position shown in FIG. 2, pull-out piece 40, driven by means of its post 39, pivots such that its rounded end 62 pushes lever 52 and thus causes sliding pinion 8 to slide, releasing it from winding pinion 21 so that it engages on intermediate motion work wheel 25. Thus, when the user rotates the crown fixed to the first stem, he rotates time-setting mechanism 24 in the same direction. The manoeuvres to be carried out on first stem 1 are thus exactly the same as on a single winding stem.

According to a variant that is not shown, the second stem 2 could slide and be secured to sliding pinion 8. Pinion 44 would then have to be longer in order to remain meshed with pinion 35 during sliding. Moreover, winding pinion 21 would have to be held axially so that it does not slide with stem 2, i.e. the length of the construction would be slightly greater than it appears in FIGS. 1 and 2.

It should also be noted that, in the embodiment shown, the control stem device is applied to winding and time-setting functions. Of course, any other function, such as date, time zone or alarm time setting, would be compatible with the device according to the invention.

What is claimed is:

1. A control stem device for a watch, including:

a first stem rotating about a longitudinal axis and provided with means for securing the first stem to a manual control crown on an exterior of the watch; and a second stem, substantially parallel and shifted in relation to the first stem and secured in rotation to a sliding pinion, the sliding pinion being mobile along a longitudinal axis of the second stem for selectively driving in rotation a mechanism for a first function and a mechanism for a second function;

wherein the first stem and second stem are connected in rotation by a transmission device, wherein the second stem has a fixed axial position, while the first stem is mounted to be axially mobile at least between a first operating position associated with the first function and a second operating position associated with the second function, so as to activate, by sliding between the first and second operating positions, a pull-out mechanism comprising a lever engaged in a peripheral groove of the sliding pinion so as to cooperate with the sliding pinion and transmit axial movements of the first stem to the sliding pinion in such a way as to make the sliding pinion pass from a first axial position to a second axial position, the sliding pinion being meshed with the mechanism for the first function in one of the first axial position and the second axial position and with the mechanism for the second function in the other of the first axial position and the second axial position.

2. The device according to claim 1, wherein said operating positions of the first stem associated with the first and second axial positions are stable.

3. The device according to claim 1, wherein the second stem is supported at both ends by fixed elements of a watch movement.

4. The device according to claim 1, wherein the second stem does not slide and includes a section having a non-circular cross section, on which the sliding pinion is slidably engaged, said pinion having a peripheral groove in which one end of a lever of the pull-out mechanism is engaged.

5. The device according to claim 4, wherein said non-circular cross-section is square.

6. The device according to claim 4, wherein said transmission device has a gear and includes a first pinion, having a central hole of non-circular cross-section slidably engaged on a non-circular cross section of the first stem, and a last pinion fixed to the second stem and permanently meshed with the first pinion.

7. The device according to claim 6, wherein said first pinion is held stationary in the axial direction by fixed elements that support the first stem.

8. The device according to claim 7, wherein the first pinion is supported by at least one of said fixed elements by a bearing.

9. The device according to claim 6, wherein said last pinion is flanked by a winding pinion freely mounted on said second stem and arranged for cooperating with a contrate toothing of the sliding pinion.

10. The device according to claim 1, wherein said first function is a winding function and said second function is a time-setting function.

* * * * *